US008605024B2

(12) United States Patent
Yamagishi

(10) Patent No.: US 8,605,024 B2
(45) Date of Patent: Dec. 10, 2013

(54) LIQUID CRYSTAL DISPLAY DEVICE

(75) Inventor: Yasuhiko Yamagishi, Mobara (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1915 days.

(21) Appl. No.: 11/648,659

(22) Filed: Jan. 3, 2007

(65) Prior Publication Data

US 2007/0152942 A1 Jul. 5, 2007

(30) Foreign Application Priority Data

Jan. 5, 2006 (JP) ..... 2006-000461

(51) Int. Cl.
*G09G 3/36* (2006.01)

(52) U.S. Cl.
USPC ..... 345/96

(58) Field of Classification Search
USPC ..... 345/54, 79, 96, 209
See application file for complete search history.

(56) References Cited

U.S. PATENT DOCUMENTS

2003/0043103 A1* 3/2003 Yoshihara et al. ..... 345/87
2003/0090449 A1* 5/2003 Arimoto et al. ..... 345/87
2005/0285837 A1 12/2005 Akimoto

FOREIGN PATENT DOCUMENTS

CN 1716378 A 6/2005

* cited by examiner

*Primary Examiner* — Fred Tzeng
(74) *Attorney, Agent, or Firm* — Stites & Haribson PLLC; Juan Carlos A. Marquez, Esq.; Nicolas B. Trenkle

(57) ABSTRACT

To keep down deterioration in picture quality caused by an AC driving method to enable image display with high quality to be achieved. In the invention, each of the pixels in a first frame just after the phase inversion for a predetermined starting time period is driven so that each of the pixels would be in a driving state of the polarity opposite to the polarity in the driving state in a last frame before the phase inversion, and then, each of the pixels is driven so that each of the pixels would be in a driving state of the polarity same as the polarity in the driving state in a last frame before the phase inversion when the driving circuit changes a driving state of each of the pixels from a positive polarity to a negative polarity or from the negative polarity to the positive polarity in every m (m≥1) frame and inverses a phase of the driving state of each of the pixels in every N (N≥m) frame wherein it is assumed that an image voltage having a potential higher than an opposite voltage applied to the opposite electrode is applied to the pixel electrode in a driving state of the positive polarity and that an image voltage having a potential lower than the opposite voltage applied to the opposite electrode is applied to the pixel electrode in a driving state of the negative polarity.

10 Claims, 5 Drawing Sheets

LIQUID CRYSTAL DISPLAY DEVICE

CROSS-REFERENCE TO RELATED APPLICATIONS

The disclosure of Japanese Patent Application No. 2006-461 filed on Jan. 5, 2006 including the specification, drawings and abstract is incorporated herein by reference in its entirety.

BACKGROUND OF THE INVENTION

1. Field of the Invention

The present invention relates to a liquid crystal display device, particularly, a liquid crystal display device capable of keeping picture quality from deterioration caused by an AC driving method to achieve image display with high quality.

2. Description of the Related Art

A liquid crystal display module is used as a display device for a highly addressable color monitor of a computer and other information apparatuses or a TV set.

A liquid crystal display module basically includes a so-called liquid crystal display panel having a liquid crystal layer held between two (a pair of) substrates at least one of which is made of transparent glass. A voltage is selectively applied to various kinds of electrodes for forming a pixel, the electrodes formed on a substrate of the liquid crystal display panel, to switch a predetermined pixel on and off. A liquid crystal display module is superior in contrast performance and high-speed display performance.

FIG. 4 is a block diagram showing a schematic structure of a conventional liquid crystal display module.

The liquid crystal display module shown in FIG. 4 comprises a liquid crystal display panel 1, a gate driver part 2, a source driver part 3, a display controlling circuit 4 and a supply circuit 5.

The gate driver part 2 and the source driver part 3 are provided on the periphery of the liquid crystal display panel 1. The gate driver part 2 is formed from plural gate driver ICs provided on one side of the liquid crystal display panel 1. The source driver part 3 is formed from plural source driver ICs provided on another side of the liquid crystal display panel 1.

The display controlling circuit 4 performs timing adjustment for a display signal inputted from a display signal source (on a host side) such as a personal computer and a television receiving circuit so as to be suitable for display of the liquid crystal display panel 1 such as current alternation of data and converts the display signal into display data in a display form to be inputted to the gate driver part 2 and the source driver part 3 together with a synchronizing signal (a clock signal).

The gate driver part 2 and the source driver part 3 supply a scanning line with a scanning voltage on the basis of control of the display controlling circuit 4 and supply an image line with an image voltage to display an image. The supply circuit 5 generates various kinds of voltages necessary for the liquid crystal display device.

FIG. 5 illustrates an equivalent circuit of a pixel part of the liquid crystal display panel 1 shown in FIG. 4. FIG. 5 corresponds to geometrical arrangement of actual pixels. Plural sub pixels arranged in the shape of a matrix in a viewing display area (a pixel part) are formed from thin film transistors (TFTs), every one of which is used for one sub pixel.

In FIG. 5, DR, DG and DB denote image lines (also referred to as drain lines or source lines), G denotes a scanning line (also referred to as a gate line) and R, G and B denote pixel electrodes (ITO1) for respective colors (red, green and blue) Further, ITO2 denotes an opposite electrode (a common electrode), C1*c* denotes liquid crystal capacity equivalently indicating the liquid crystal layer and Cstg denotes holding capacity formed between a common signal line COM and a source electrode.

In the liquid crystal display panel 1 shown in FIG. 4, drain electrodes of thin film transistors (TFTs) of the respective pixels provided in a column direction are respectively connected to image lines (DR, DG and DB). The respective image lines (D) are connected to a source driver part 3 for supplying pixels provided in a column direction with an image voltage corresponding to display data.

Gate electrodes of thin film transistors (TFTs) of the respective pixels provided in a row direction are respectively connected to scanning lines (G). The respective scanning lines (G) are connected to a gate driver part 2 for supplying gates of the thin film transistors (TFT) with a scanning voltage (a positive or negative bias voltage) for one horizontal scanning period.

In displaying an image on the liquid crystal display panel 1, the gate driver part 2 selects the scanning lines (G0, G1, . . . Gj, Gj+1) from the upper part to the lower part (in the order of G0→G1) while the source driver part 3 supplies the image lines (DR, DG and DB) with an image voltage corresponding to the display data to apply the voltage to a pixel electrode (ITO1) during the selection period of a certain scanning line.

It is premised here that an operation is carried out in a so-called normally black-displaying mode in which the larger the image voltage supplied to the respective pixels is, the higher the luminance is.

A voltage supplied to the image line (D) is applied to the pixel electrode (ITO1) via a thin film transistor (TFT), and finally, holding capacity (Cstg) and liquid crystal capacity (Clc) are charged with electric charge and liquid crystal molecules are controlled to display an image.

The above-mentioned operation is described hereinafter with reference to a timing waveform.

FIG. 6 illustrates a voltage waveform outputted from the gate driver part 2 to the scanning line (G) and a voltage wavelength on an image line of an image voltage (VD) outputted from the source driver part 3 in a liquid crystal display module shown in FIG. 4.

A clock (CL1) shown in FIG. 6 is a clock for controlling output timing. The source driver part 3 outputs an image voltage (VD in FIG. 6) corresponding to the display data to the image lines (DR, DG and DB) from a point of falling time of the clock (CL1). FIG. 6 shows a voltage waveform of the image voltage (VD) in the case of displaying white.

The image voltage (VD) supplied to the image lines (DR, DG and DB) is AC-driven by switching the polarity between an image voltage with high potential with respect to a common voltage (VCOM) applied to the opposite electrode (ITO2) (referred to as an image voltage of the positive polarity (+), hereinafter) and an image voltage with low potential with respect to the common voltage (VCOM) (referred to as an image voltage of the negative polarity (−), hereinafter) for every horizontal scanning period (1H) in order to prevent the current voltage from being applied to liquid crystal capacity (Clc) in FIG. 5. FIG. 6 shows a case of using a dot inversion method, which is one of a common symmetry method, as an AC driving method.

On the other hand, a scanning voltage (VG) at a high level (referred to as an H level, hereinafter) is applied from the gate driver part 2 for one horizontal scanning period (1H) in the order of vertical scanning of the scanning lines (G0, G1, . . . Gj, Gj+1). Turning on, that is, selecting all the thin film transistors (TFTs) connected to the scanning line allows the image voltage (VD) outputted from the source driver part 3 to be applied to the liquid crystal capacity (Clc) and the holding capacity (Cstg).

Contrary to the above, in the case of the scanning voltage (VG) at a low level (referred to as an L level, hereinafter), all of the thin film transistors (TFTs) connected to the scanning lines (G0, G1, . . . Gj, Gj+1) are turned off, that is, not selected.

The waveform of the image voltage (VD) becomes dull in rising and falling processes of the image voltage (VD) in accordance with wiring resistance of the image lines (DR, DG and DB) and a time constant of the liquid crystal capacity (Clc), as shown in FIG. 6. Accordingly, the scanning voltage (VG) is changed from a voltage at the H level in a selection period to a voltage at the L level in a non-selection period after the image voltage (VD) is sufficiently saturated.

In the horizontal scanning period (N) in FIG. 6, for example, a slight difference in time (Tgd) is given from a point of time when the image voltage (VD) having the positive polarity is sufficiently saturated to a point of falling time of the clock (CL1) when the image voltage (VD) in a preceding horizontal scanning period (N+1) is outputted so as to change the scanning voltage (VG) from a voltage at the H level to a voltage at the L level.

Tgd is referred to as gate delay time in the following specification.

FIG. 7 is a simplified view simply showing pixel polarity and a pixel voltage level of a certain pixel in the case that white and black are alternately displayed for every vertical scanning period (referred to as a frame, hereinafter) in the conventional liquid crystal display module.

The pixel voltage shows a pattern that it is biased to a positive polarity side (a plus side) with respect to the common voltage (VCOM) and direct current is applied to the liquid crystal as an effective value when the image voltage changes in accordance with an AC cycle of the liquid crystal such as "white display" in negative polarity and "black display" in positive polarity, as shown in FIG. 7.

The pattern, especially, often occurs in the case of displaying a moving picture image and a direct current signal is always applied to the liquid crystal in the pattern. This causes deterioration in display quality as well as great deduction in life of the liquid crystal per se.

Further, display data in which white and black images alternately change in every frame often occurs in conversion from an interlaced (jump) scanning signal such as a television signal into progressive (sequential) scanning in liquid crystal driving. In the case of viewing a television image or a DVD image, which is displayed on the liquid crystal display module, for example, occurs a bias of a driving voltage of the liquid crystal. This causes deterioration in picture quality.

FIG. 8 shows pixel polarity in every frame in the case of inversing a phase of the pixel polarity in a certain fixed cycle (Period A and Period B) in the AC driving method shown in FIG. 7.

The pixel voltage in a first frame in Period A has a positive polarity (+) in accordance with a phase inversion signal shown in FIG. 8 while the voltage starts from the negative polarity (−) in Period B. Accordingly, the pixel polarity in the respective sections in Periods A and B is all opposite to each other such as positive (+) and negative (−) polarity.

Such an AC driving method is referred to as a phase inversion driving method in the specification hereinafter.

FIG. 9 is a simplified view simply showing pixel polarity and a pixel voltage level of a certain pixel in the case that white and black are alternately displayed in every frame in the phase inversion driving method.

As shown in FIG. 9, the pixel voltage biased to a negative polarity side (a minus side) with respect to the common voltage (VCOM) is to be biased to the positive polarity side (the plus side) after the inversion of the phase in accordance with the phase inversion driving method. As described above, carrying out an AC drive so that a bias of the pixel voltage would be on the positive polarity side or on the negative polarity side in a certain fixed cycle allows an effective direct current voltage applied to the liquid crystal to be reduced, as a result.

On the other hand, seeing the pixel polarity in the N-th frame and the pixel polarity in the first frame after a phase inversion switch, which are shown in FIG. 9, it is found that the positive (plus (+)) pixel polarity continues. In continuance of the same pixel polarity, there is sometimes a case of {(−)→(−)} or {(+)→(+)} in accordance with the timing of a switch in the phase inversion.

In the case of continuance of the pixel polarity, a condition for driving the liquid crystal (current alternation) is changed in appearance, so that flicker occurs on a display screen as a side effect.

The flicker occurs in the first frame with switch timing of the phase inversion signal shown in FIG. 8, that is, just after rising or falling of the phase inversion signal. As a result, the phase inversion drive has an effect of preventing the direct current voltage from being applied to the liquid crystal as well as a side effect of occurrence of flicker, which causes a problem that display quality is deteriorated, on the other hand.

SUMMARY

The invention is to solve the above problems in the prior arts. An object of the invention is to provide a technology capable of keep down deterioration in picture quality due to the AC driving method to display an image with high quality in a liquid crystal display device.

The above-mentioned and other objects and new characteristics of the invention will be disclosed on the basis of the description of the specification and the attached drawings.

Brief description of an outline of represented parts of the invention disclosed in the application is as follows.

(1) In a liquid crystal display device comprising: a liquid crystal display panel including plural pixels; and a driving circuit for driving each of the pixels, wherein each of the pixels has a pixel electrode and an opposite electrode and the driving circuit changes a driving state of each of the pixels from a positive polarity to a negative polarity or from the negative polarity to the positive polarity in every m (m≥1) frame and inverses a phase of the driving state of each of the pixels in every N (N≥m) frame wherein it is assumed that an image voltage having a potential higher than an opposite voltage applied to the opposite electrode is applied to the pixel electrode in a driving state of the positive polarity and that an image voltage having a potential lower than the opposite voltage applied to the opposite electrode is applied to the pixel electrode in a driving state of the negative polarity, the driving circuit drives each of the pixels in a first frame just after the phase inversion for a predetermined starting time period so that each of the pixels would be in a driving state of the polarity opposite to the polarity in the driving state in a last frame before the phase inversion, and then, drives each of the pixels so that each of the pixels would be in a driving state of the polarity same as the polarity in a driving state in a last frame before the phase inversion.

(2) In a liquid crystal display device comprising: a liquid crystal display panel including plural pixels; and a driving circuit for driving each of the pixels, wherein each of the pixels has a pixel electrode and an opposite electrode and the driving circuit changes a driving state of each of the pixels from a positive polarity to a negative polarity or from the negative polarity to the positive polarity in every m (m≥1) frame and inverses a phase of the driving state of each of the pixels in every N (N≥m) frame wherein it is assumed that an image voltage having a potential higher than an opposite voltage applied to the opposite electrode is applied to the pixel electrode in a driving state of the positive polarity and that an image voltage having a potential lower than the opposite voltage applied to the opposite electrode is applied to the pixel electrode in a driving state of the negative polarity, the driving circuit changes the driving state of each of the pixels in every one display line in each frame period from the positive polarity to the negative polarity or from the negative polarity to the positive polarity and further applies an image voltage, the image voltage applied to a pixel electrode of each of the pixels in a preceding display line, to each of the pixels in any display line in a first frame just after the phase inversion for a predetermined starting time period of one horizontal scanning period, and then, applies an image voltage for each of the pixels, the latter image voltage applied to the pixels in any display line.

(3) In (1) or (2), TA1<TA2 is satisfied wherein TA1 denotes the predetermined time period and TA2 denotes one horizontal scanning period.

(4) In (3), TA1≥TA2/3 is satisfied.

(5) In a liquid crystal display device comprising: a liquid crystal display panel including plural pixels; and a driving circuit for driving each of the pixels, wherein each of the pixels has a pixel electrode, an active element and an opposite electrode and the driving circuit changes a driving state of each of the pixels from a positive polarity to a negative polarity or from the negative polarity to the positive polarity in every m (m≥1) frame and inverses a phase of the driving state of each of the pixels in every N (N≥m) frame wherein it is assumed that an image voltage having a potential higher than an opposite voltage applied to the opposite electrode is applied to the pixel electrode in a driving state of the positive polarity and that an image voltage having a potential lower than the opposite voltage applied to the opposite electrode is applied to the pixel electrode in a driving state of the negative polarity, output timing of a selection voltage for tuning on the active element of each of the pixels in the first frame just after the phase inversion is different from output timing of a selection voltage for tuning on the active element of each of the pixels in a frame other than the first frame just after the phase inversion in the driving circuit.

(6) In (5), T1>T2, more preferably, T1≥3×T2 wherein T1 denotes an interval between the output timing of a selection voltage for tuning on the active element in the first frame just after the phase inversion and timing of applying an image voltage to the pixel electrode and T2 denotes an interval between the output timing of a selection voltage for tuning on the active element of each of the pixels in a frame other than the first frame just after the phase inversion and the timing of applying an image voltage to the pixel electrode.

(7) In a liquid crystal display device comprising: a liquid crystal display panel including plural pixels; and a driving circuit for driving each of the pixels, wherein each of the pixels has a pixel electrode, an active element and an opposite electrode and the driving circuit changes a driving state of each of the pixels from a positive polarity to a negative polarity or from the negative polarity to the positive polarity in every m (m≥1) frame and inverses a phase of the driving state of each of the pixels in every N (N≥m) frame wherein it is assumed that an image voltage having a potential higher than an opposite voltage applied to the opposite electrode is applied to the pixel electrode in a driving state of the positive polarity and that an image voltage having a potential lower than the opposite voltage applied to the opposite electrode is applied to the pixel electrode in a driving state of the negative polarity, the driving circuit stops selection scanning for turning on the active element of each of the pixels in every one display line in the first frame just after the phase inversion.

(8) In (1) to (7), "m" is one.

(9) In (1) to (8), the opposite voltage applied to the opposite electrode is a constant voltage.

EFFECT OF THE INVENTION

A simple description of an effect achieved by the represented parts of the invention disclosed in the application is as follows.

In accordance with the invention, deterioration in picture quality, which is caused by the AC driving method, can be kept down to display image with high quality.

DETAILED DESCRIPTION OF THE INVENTION

Embodiments of the invention will be described in detail hereinafter, made reference to drawings.

In all the drawings illustrating the embodiments, what has the same function is marked with the same signs and numerals and repeated description thereof will be omitted.

Embodiment 1

Figure 4:
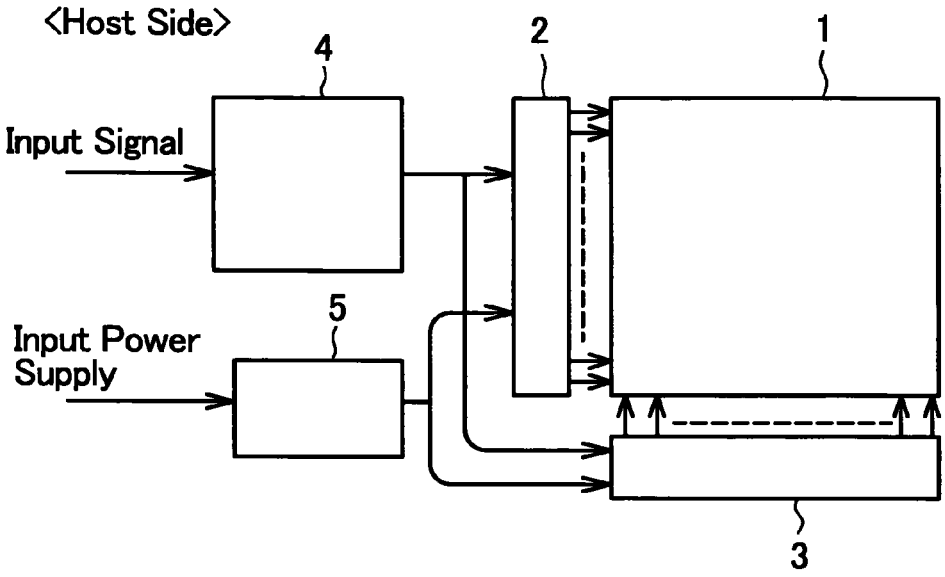
FIG. 4 is a block diagram showing a schematic structure of a conventional liquid crystal display module.
Figure 5:
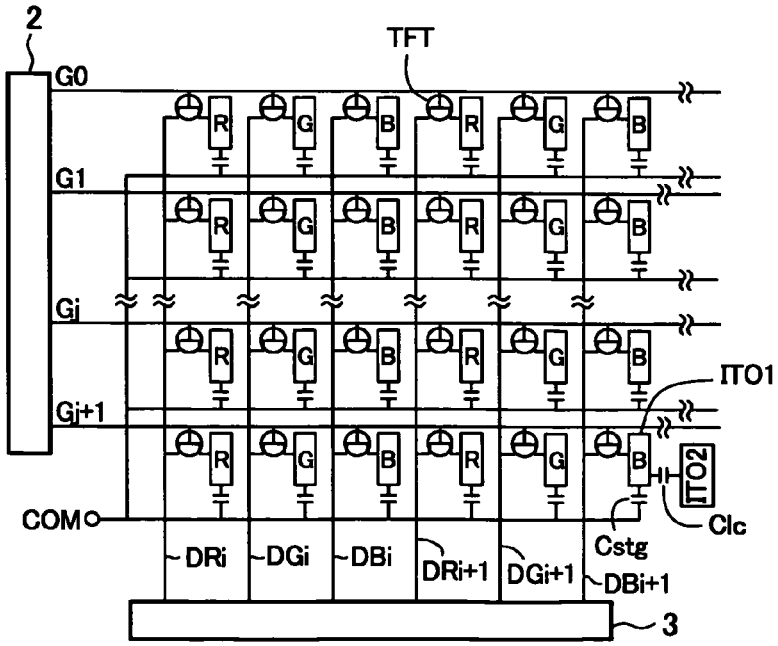
FIG. 5 illustrates an equivalent circuit in a pixel part of a liquid crystal display panel shown in FIG. 4.

A schematic structure of a liquid crystal display module in accordance with Embodiment 1 of the invention is same as that of the conventional liquid crystal display module shown in FIG. 4 described above. Accordingly, description of the schematic structure of a liquid crystal display module in accordance with Embodiment 1 of the invention is omitted.

Figure 1A:
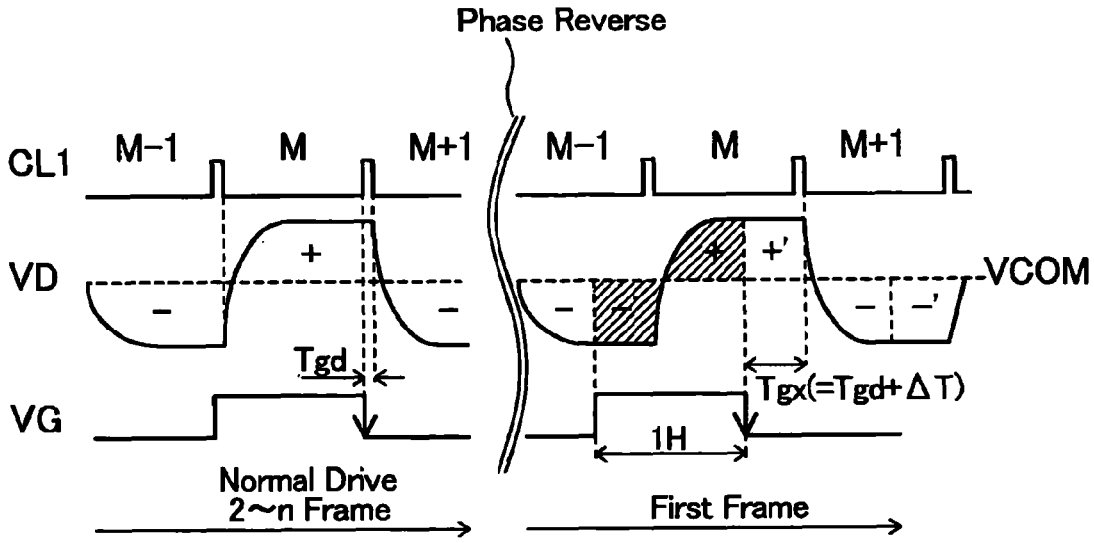
FIG. 1A illustrates a voltage waveform outputted from a gate driver part to a scanning line and a voltage wavelength on an image line of an image voltage outputted from a source driver part in a liquid crystal display module in accordance with Embodiment 1 of the invention.

FIG. 1A illustrates a voltage waveform outputted from a gate driver part 2 to a scanning line (G) and a voltage wavelength on an image line of an image voltage (VD) outputted from a source driver part 3 in a liquid crystal display module in accordance with Embodiment 1 of the invention.

Figure 6:
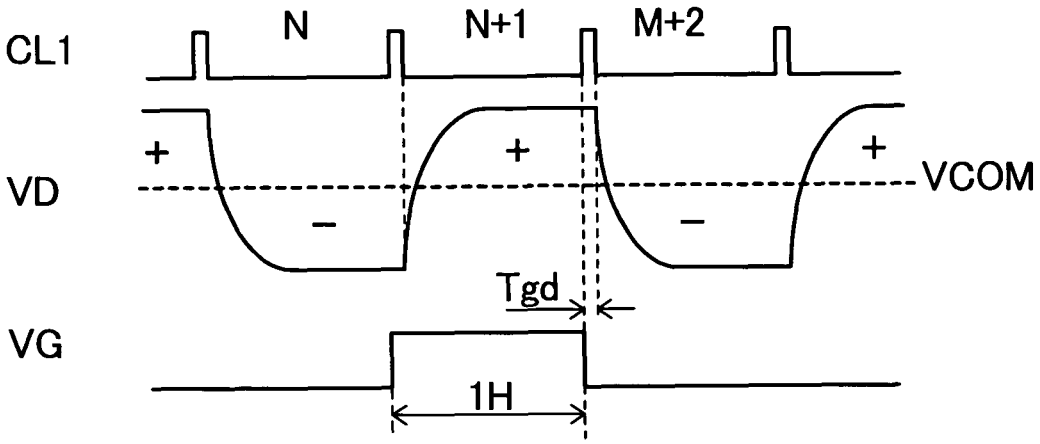
FIG. 6 illustrates a voltage waveform outputted from the gate driver part to the scanning line and a voltage wavelength on an image line of an image voltage outputted from the source driver part in a conventional liquid crystal display module.
Figure 7:
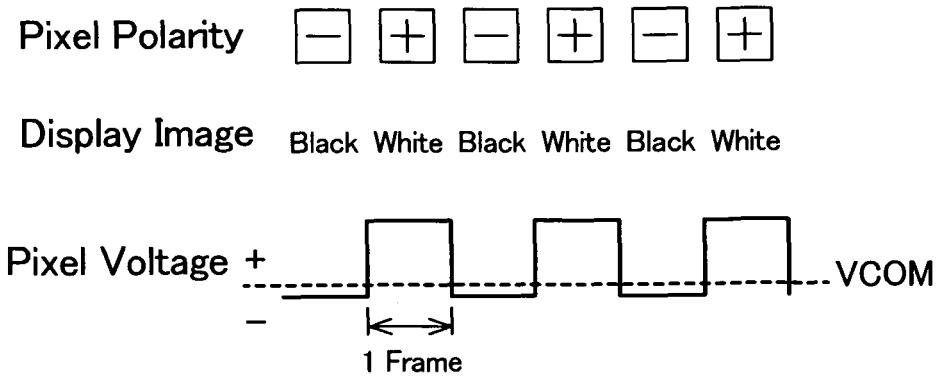
FIG. 7 is a simplified view simply showing pixel polarity and a pixel voltage level of a certain pixel in the case that white and black are alternately displayed in every frame in a conventional liquid crystal display module.

In FIG. 1A and FIG. 6 described above, (−) and (+) denote final polarity of a pixel while (−') and (+') denote polarity temporarily applied to a pixel.

A waveform shown on the right side in FIG. 1A indicates a voltage waveform in an M-th horizontal scanning period in a first frame just after phase inversion in phase inversion of the pixel polarity in every N-th frame. A waveform shown on the left side in FIG. 1A simply indicates a voltage waveform in an M-th horizontal scanning period in a period from a second frame to an N-th frame just before the phase inversion.

The waveform shown on the left side in FIG. 1A, the waveform being in an M-th horizontal scanning period in a period from a second frame to an N-th frame just before the phase inversion, indicates a voltage waveform in a normal drive in which an image voltage (VD) having positive polarity (plus polarity) is applied to a pixel by switching a scanning voltage (VG) from a selection voltage at an H level to a non-selection voltage at an L level at a time when the image voltage (VD) is sufficiently saturated, that is, with timing of gate delay time (Tgd), as illustrated in FIG. 6.

On the other hand, in the waveform shown on the right side in FIG. 1A, the waveform being an M-th horizontal scanning period in a first frame just after phase inversion, the scanning voltage (VG) rises at a point of time substantially (½) of the (M−1)-th horizontal scanning period and falls at a point of time substantially (½) of the M-th horizontal scanning period.

Accordingly, gate delay time (Tgx) in the M-th horizontal scanning period can be expressed by a value obtained by adding fluctuation delay time (ΔT) to the gate delay time (Tgd) in a normal drive, that is, Tgx (=Tgd+ΔT). A relation between Tgx and Tgd is preferably Tgx≥3×Tgd.

In other words, the fluctuation delay time (ΔT) is set so that effective application time of the image voltage (VD) would be almost same between the pixel polarity (−') and the pixel polarity (+).

Setting the gate delay time at Tgx in the first frame period just after phase inversion allows an image voltage (VD) having the negative polarity (the minus polarity (−')) in the (M−1)-th horizontal scanning period and an image voltage (VD) having the positive polarity (the plus polarity (+)) in the M-th horizontal scanning period to be controlled so as to be applied at the same time in one horizontal scanning period instead of sufficiently applying the image voltage (VD) having the positive polarity (the plus polarity (+)) to a pixel in the M-th horizontal scanning period in an original case.

Further, in the subsequent (M+1)-th horizontal scanning period, carried out is control with polarity inverse to the above description. The above is repeated subsequently.

Figure 2:
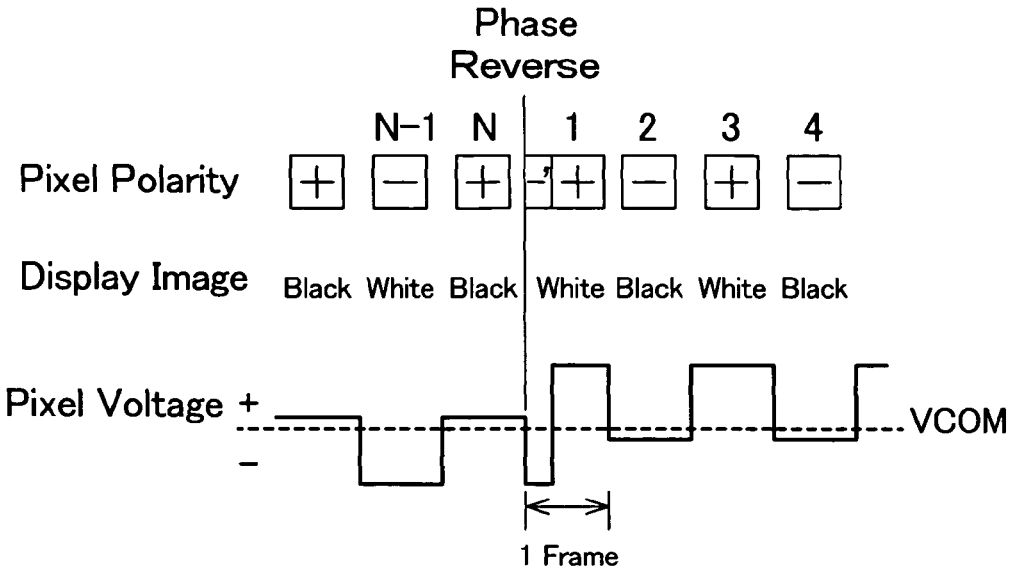
FIG. 2 is a simplified view simply showing pixel polarity and a pixel voltage level of a certain pixel in the case that white and black are alternately displayed in every frame in the liquid crystal display module in accordance with Embodiment 1 of the invention.

FIG. 2 is a view simply showing a certain pixel voltage and pixel polarity in every frame for the image voltage of white and black in the liquid crystal display module in accordance with Embodiment 1 of the invention.

Figure 8:
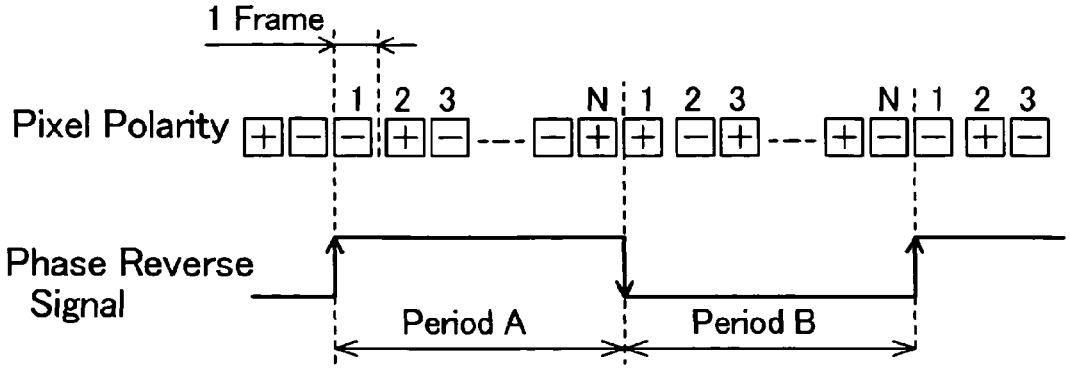
FIG. 8 shows pixel polarity for every frame in the case of inversing a phase of the pixel polarity in a certain fixed cycle (Period A and Period B) in an AC driving method shown in FIG. 7.
Figure 9:
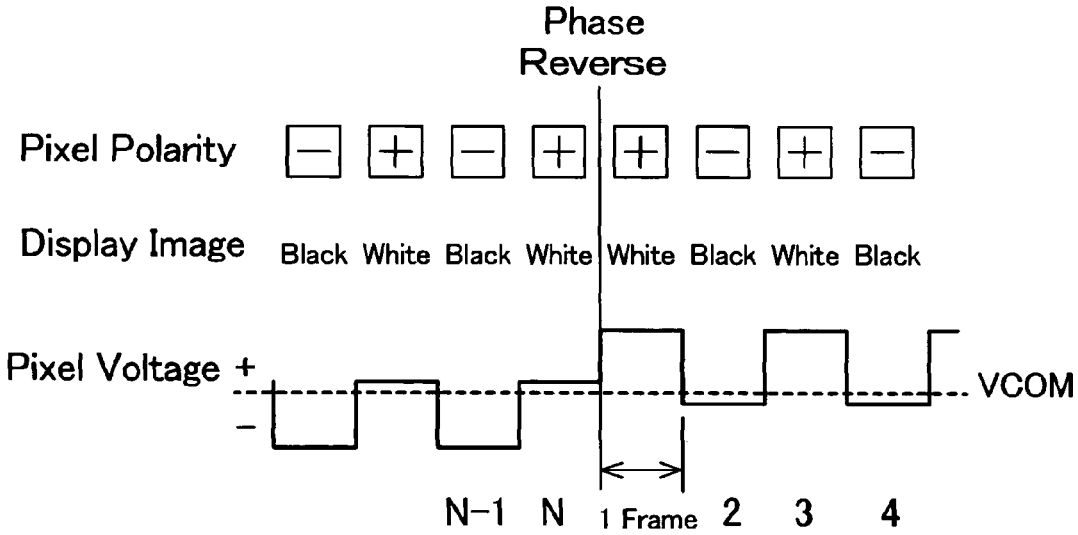
FIG. 9 is a simplified view simply showing pixel polarity and a pixel voltage level of a certain pixel in the case that white and black are alternately displayed for every frame in a phase inversion driving method.

In the case that white and black are alternately displayed in every frame and that a phase inversion drive is carried out in every N-th frame, the pixel voltage before the N-th frame is biased to a negative polarity side (a minus side) with respect to a common voltage (VCOM) and the pixel voltage in the first and subsequent frames after the phase inversion is biased to a positive polarity side (a plus side), as illustrated in FIGS. 8 and 9.

At the same time, the pixel polarity in the last N-th frame before a switch of the phase inversion and in the first frame after the switch of the phase inversion is continued as (+)→(+). The driving method described with reference to FIG. 1, however, allows the negative polarity (the minus polarity) and the positive polarity (the plus polarity) to be written at the same time in one horizontal scanning period. Accordingly, an image voltage having the negative polarity (the minus polarity (−')) is temporarily generated as shown in FIG. 2, so that the pixel polarity at a point of time close to the switch of the phase inversion drive changes as (+)→(−')→(+). An effect of the generated pseudo-negative polarity (−') allows continuance of the same pixel polarity such as (+)→(+) to be prevented, and therefore, continuance of positive polarity (+) and the negative polarity (−) of the pixel polarity in appearance can be kept. This allows a flicker in the phase inversion, which is pointed out in FIGS. 8 and 9, to be prevented from occurring.

In an example shown in FIG. 1A, the image voltage (VD) having the negative polarity (the minus polarity (−')) in the (M−1)-th horizontal scanning period and the image voltage (VD) having the positive polarity (the plus polarity (+)) in the M-th horizontal scanning period are simultaneously applied in one horizontal scanning period in one frame period just after the phase inversion.

In the first horizontal scanning period, however, exists no image voltage (VD) having the negative polarity in a preceding horizontal scanning period.

Accordingly, utilized is a fact that the image voltage for black is applied in a vertical blank period in a normally black display mode while the image voltage for white is applied in the vertical blank period in a normally white display mode, generally. That is to say, in the example shown in FIG. 1A, the image voltage (VD) for black, the image voltage having the negative polarity (the minus polarity (−')), in a vertical blank period and the image voltage (VD) having the positive polarity (the plus polarity (+)) in the first horizontal scanning period are applied simultaneously in the first horizontal scanning period in the first frame period just after the phase inversion.

Figure 1B:
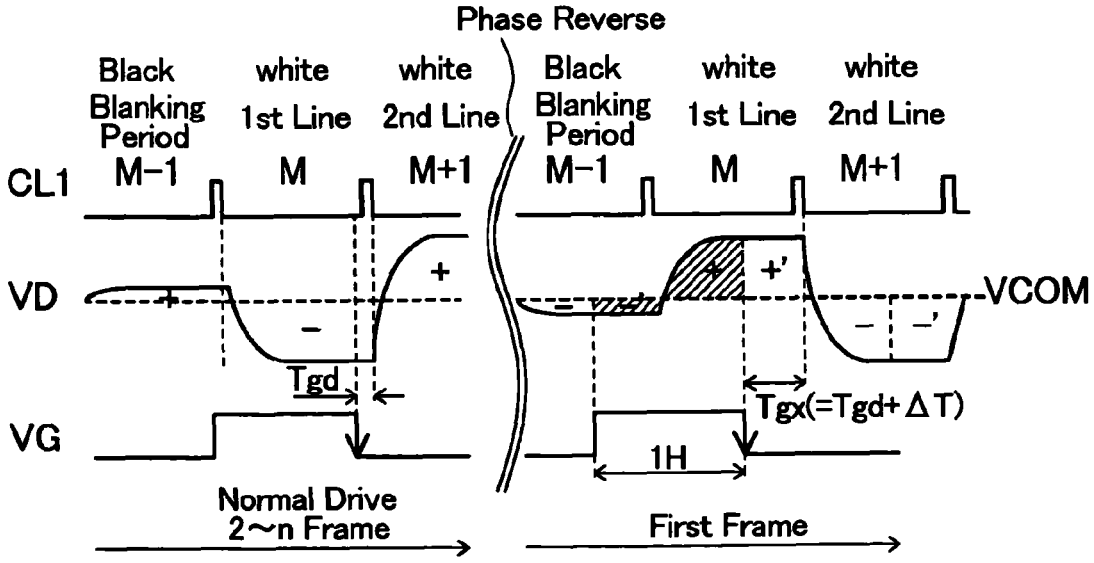
FIG. 1B illustrates another example of a voltage waveform outputted from a gate driver part to a scanning line (G) and a voltage wavelength on an image line of an image voltage (VD) outputted from a source driver part in a liquid crystal display module in accordance with Embodiment 1 of the invention.

FIG. 1B illustrates another example of a voltage waveform outputted from a gate driver part 2 to a scanning line (G) and a voltage wavelength on an image line of an image voltage (VD) outputted from a source driver part 3 in a liquid crystal display module in accordance with Embodiment 1 of the invention.

A waveform shown on the right side in FIG. 1B indicates a voltage waveform in the first horizontal scanning period in the first frame just after phase inversion in inversing a phase of the pixel polarity in every N-th frame. A waveform shown on the left side in FIG. 1B simply indicates a voltage waveform in the first horizontal scanning period in a period from a second frame to an N-th frame just before the phase inversion. FIG. 1B shows voltage waveforms in the case of indicating white.

Embodiment 2

Figure 3:
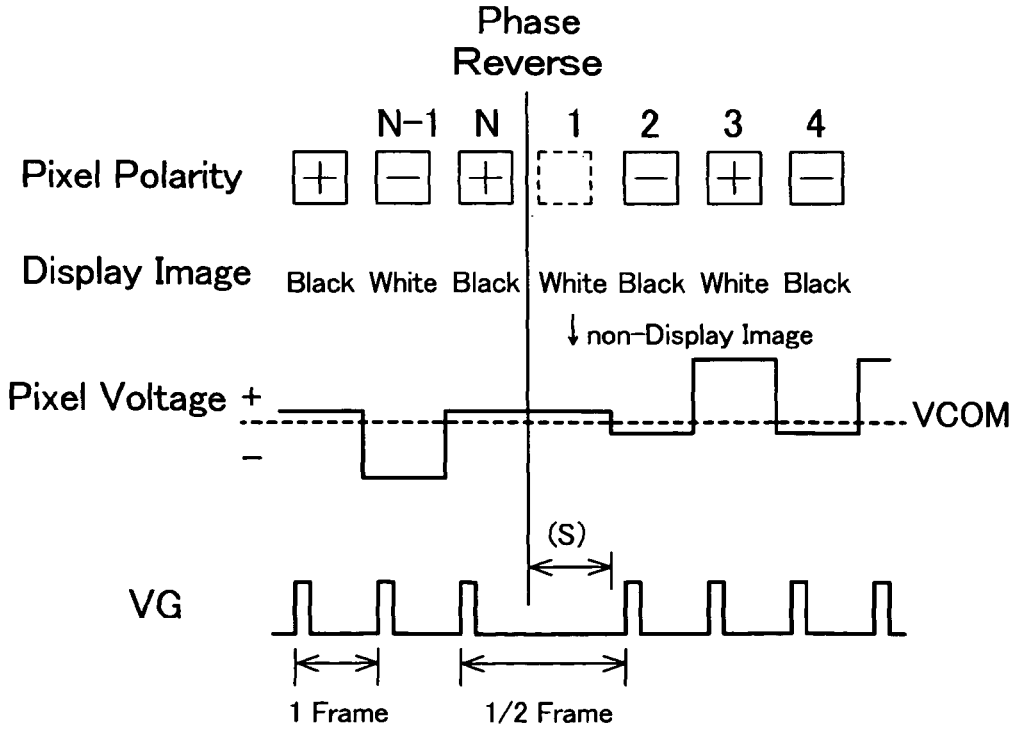
FIG. 3 is a simplified view showing a certain pixel voltage and pixel polarity and a gate scanning voltage (VG) in the case that white and black are alternately displayed in every frame in the liquid crystal display module in accordance with Embodiment 2 of the invention.

FIG. 3 is a view simply showing a certain pixel voltage and pixel polarity and a gate scanning voltage (VG) in every frame for the image voltage of white and black in a liquid crystal display module in accordance with Embodiment 2 of the invention.

In Embodiment 2, carried out is control to keep the image voltage of black, which has the positive polarity (the plus (+) polarity) and which is applied in the N-th frame before the phase inversion, without applying any image voltage to a pixel during one frame period, as shown in FIG. 3, instead of stopping the scanning itself of the gate signal line (G) in the first frame just after the phase inversion to apply the image voltage of white to a pixel, originally.

Accordingly, the scanning voltage (VG) in a certain gate line is usually driven in a cycle of one frame (about 60 Hz, for example), but the scanning voltage (VG) is driven in the ½ frame (about 30 Hz, for example) from a point of view of a period from the N-th frame to the second frame.

Such control allows the pixel polarity per a frame to be (+)→(−) in appearance instead of continuance of the same pixel polarity (+)→(+)→(−) from the N-th frame.

As a result, continuance of the pixel polarity (+) and (−) is kept similarly to the usual drive as described with reference to FIG. 2, so that no flicker occurs in phase inversion.

It goes without saying that the similar effect can be obtained even in the case that the pixel polarity is all inversed in the description with reference to FIGS. 2 and 3. Further, it causes no problem to put the above-mentioned driving method into practice not only in the first frame after the phase inversion but also in the second and subsequent frames. Moreover, the invention is applicable even in the case that the pixel polarity in every frame in the usual drive is not continuance of (+)→(−) but a combination of current alternation such as (+)→(+)→(−)→(−), for example.

As described above, using a phase inversion drive causes continuance of the same pixel polarity with timing of switching the phase inversion drive in the case of alternately displaying white and black in every frame, and thereby, a temporary change in liquid crystal driving characteristic. This results in occurrence of a flicker.

In Embodiment 2, however, keeping the continuance of the pixel polarity (+)→(−) in the first frame just after the phase inversion allows the flicker to be reduced. This allows the direct current to be prevented from being applied to the liquid crystal and stable and excellent display to be always obtained.

In the above description, described are embodiments in which the invention is applied to a liquid crystal display module using as an AC driving method a common symmetry method (a dot inversion method, for example) in which a voltage of an opposite electrode (ITO2) is constant. The invention however, is not limited to the above. The invention may be applicable to a liquid crystal display module using as an AC driving method a common inversion method (a one line inversion method, for example) in which a voltage of the opposite electrode (ITO2) fluctuates between a voltage at the H level and a voltage at the L level.

The invention by the present inventor has been concretely described on the basis of the embodiments. It is obvious, of course, however, that the invention is not limited to the above embodiments and may be variously modified within a range not deviating from the spirit of the invention.

What is claimed is:

1. A liquid crystal display device comprising:

a liquid crystal display panel including a plurality of pixels; and a driving circuit for driving each of the pixels, wherein each of the pixels has a pixel electrode and an opposite electrode, wherein the driving circuit changes a driving state of each of the pixels from a positive polarity to a negative polarity or from the negative polarity to the positive polarity in every m (m≥1) frame and performs a phase inversion of the driving state of each of the pixels in every N (N=2m×n, n≥1) frame wherein it is assumed that an image voltage having a potential higher than an opposite voltage applied to the opposite electrode is applied to the pixel electrode in a driving state of the positive polarity and that an image voltage having a potential lower than the opposite voltage applied to the opposite electrode is applied to the pixel electrode in a driving state of the negative polarity, and wherein the driving circuit drives each of the pixels so as to maintain a scanning voltage at a selection voltage for a period that includes a change from an image voltage having an opposite polarity to a polarity of a most recent frame prior to performing the phase inversion to an image voltage having a same polarity as the polarity of the most recent frame prior to the phase inversion.

2. The liquid crystal display device according to claim 1, wherein TA1<TA2 is satisfied wherein TA1 denotes a predetermined time period during which the image voltage maintains the opposite polarity to the polarity of most recent frame prior to the phase inversion and TA2 denotes one horizontal scanning period.

3. The liquid crystal display device according to claim 2, wherein TA1≥TA2/3 is satisfied.

4. The liquid crystal display device according to claim 1, wherein "m" is one.

5. The liquid crystal display device according to claim 1, wherein the opposite voltage applied to the opposite electrode is a constant voltage.

6. A liquid crystal display device comprising:

a liquid crystal display panel including plural pixels; and a driving circuit for driving each of the pixels, wherein each of the pixels has a pixel electrode, an active element, and an opposite electrode, wherein the driving circuit changes a driving state of each of the pixels from a positive polarity to a negative polarity or from the negative polarity to the positive polarity in every m (m≥1) frame and inverses a phase of the driving state of each of the pixels in every N (N=2m×n, n≥1) frame wherein it is assumed that an image voltage having a potential higher than an opposite voltage applied to the opposite electrode is applied to the pixel electrode in a driving state of the positive polarity and that an image voltage having a potential lower than the opposite voltage applied to the opposite electrode is applied to the pixel electrode in a driving state of the negative polarity, and wherein output timing of a selection voltage for tuning on the active element of each of the pixels in a first frame just after a phase inversion is different from output timing of a selection voltage for tuning on the active element of each of the pixels in a frame other than the first frame just after the phase inversion in the driving circuit.

7. The liquid crystal display device according to claim 6, wherein T1>T2 wherein T1 denotes an interval between the output timing of a selection voltage for tuning on the active element in the first frame just after the phase inversion and timing of applying an image voltage to the pixel electrode and T2 denotes an interval between the output timing of a selection voltage for tuning on the active element of each of the pixels in a frame other than the first frame just after the phase inversion and the timing of applying an image voltage to the pixel electrode.

8. The liquid crystal display device according to claim 7, wherein $T1 \geq 3 \times T2$.

9. The liquid crystal display device according to claim 6, wherein "m" is one.

10. The liquid crystal display device according to claim 6, wherein the opposite voltage applied to the opposite electrode is a constant voltage.

* * * * *